United States Patent [19]

Burns

[11] 4,239,070

[45] Dec. 16, 1980

[54] LOG SPLITTER

[75] Inventor: Thomas H. Burns, Holmes, N.Y.

[73] Assignee: Burns Double Split, Inc., Holmes, N.Y.

[21] Appl. No.: 31,768

[22] Filed: Apr. 20, 1979

[51] Int. Cl.[3] ..... B27L 7/00

[52] U.S. Cl. ..... 144/193 A

[58] Field of Search ..... 144/31 K, 193 R, 193 A, 144/323, 326 R

[56] References Cited

U.S. PATENT DOCUMENTS

| | | | |
|---|---|---|---|
| 3,077,214 | 2/1963 | Brukner | 144/193 A |
| 3,242,955 | 3/1966 | Hellstrom | 144/193 A |
| 3,319,675 | 5/1967 | Bles, Sr. | 144/193 A |
| 3,640,323 | 2/1972 | Helle | 144/193 A |
| 3,974,867 | 8/1976 | Butas, Jr. | 144/193 E |
| 3,995,672 | 12/1976 | Binninger | 144/193 A |
| 4,076,062 | 2/1978 | Kanik | 144/193 A |

*Primary Examiner*—W. Donald Bray
*Attorney, Agent, or Firm*—Jack M. Arnold

[57] ABSTRACT

A portable hydraulic log splitter in which first and second splitting wedges are mounted in fixed positions relative to one another on a fixedly positioned supporting "H" beam. A ram is slideably mounted to the upper and lower flanges of the "H" beam for movement between the first and second splitting wedges. A two-way hydraulic cylinder means controls the ram for alternately forcing supplied logs against the first and second splitting wedges respectively. In a preferred mode of operation the two-way hydraulic cylinder means is comprised of first and second two-way hydraulic cylinder means disposed on opposite sides of the "H" beam and connected to the opposite sides, respectively, of the ram means for applying a substantially equal force to each side of the ram.

11 Claims, 5 Drawing Figures

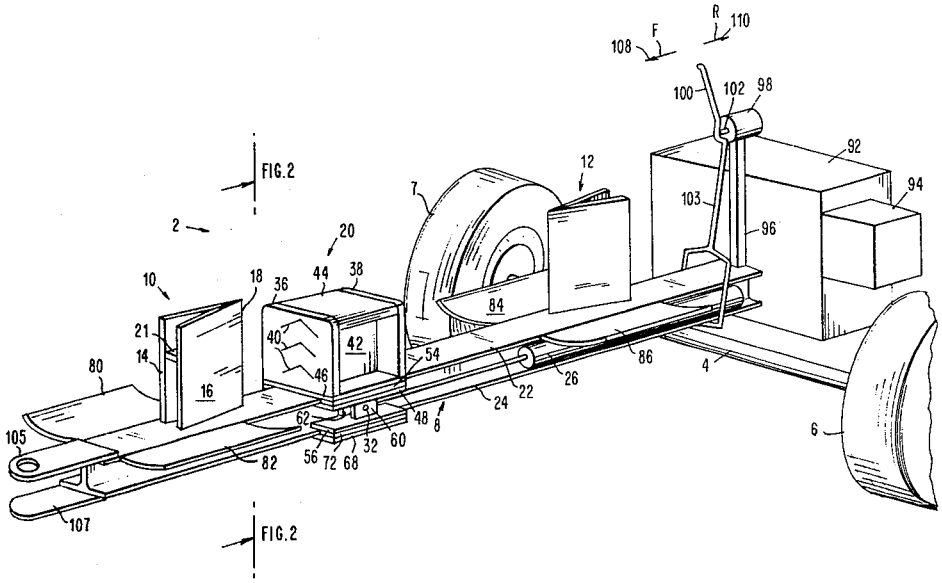

LOG SPLITTER

SUMMARY OF THE INVENTION

According to the present invention, there is a portable hydraulic log splitter including a support frame mounted to a chasis having spindles and running wheels connected thereto. First and second log splitting means are mounted on the support frame for movement between the first and second log splitting means. A two-way hydraulic cylinder means is connected to the ram means to drive the ram means towards the first log splitting means on the forward stroke of the two-way hydraulic cylinder means, and to drive the ram means towards the second log splitting means on the return stroke of the two-way hydraulic cylinder means. Accordingly, logs are cut on both the forward and return stroke of the two-way hydraulic cylinder means.

BACKGROUND OF THE INVENTION

This invention is directed to log splitting apparatus and more particularly to a portable hydraulic operated high-power log splitter which includes two log splitting means mounted in fixed positions relative to one another, on a fixedly positioned support member, such that the hydraulic cylinder means for driving a ram is operative to split or shear a supplied log on both the forward and return stroke.

In the prior art, there exists a number of log splitting devices of varying design. One such design is illustrated in U.S. Pat. No. 3,077,214 to Brukner which discloses a relatively low-power portable hydraulic log splitter in which a single wedge is mounted on a support member, with a single hydraulic cylinder means being operative to drive a ram which forces a supplied log against the wedge for splitting. Energy is lost on the return stroke of the hydraulic cylinder means to its initial position. That is, splitting is achieved only on the forward stroke of the cylinder means and the ram, and energy is expended with no splitting of logs on the return stroke of the cylinder means and the ram.

U.S. Pat. No. 3,974,867 to Butas, Jr., discloses a non-portable relatively low-power log splitter for use in a high-production environment which utilizes a four-way, step knife blade at either end of a longitudinal stroke. Each knife blade is mounted on a non-fixedly positioned support member, that is an adjustable table which must be repositioned after each longitudinal stroke to compensate for the thickness of a ram. A log is automatically placed in position between and at the center of the four-way knife blades by a hydraulically operated table. A self-centering circular ram connected to a single two-way hydraulic cylinder forces the log to either of the four-way knife blades depending upon which end of the stroke the ram was last positioned. After each log is split, the adjustable table must be repositioned, such that another log may be split. It is contemplated in the Butas, Jr. patent that logs in a limited diameter range are to be split as a function of the diameter of the ram. That is, the diameter of a log to be split may be no greater than the diameter of the ram.

According to the present invention, high-power portable hydraulic log splitting apparatus is disclosed, in which two log splitting means are situated in fixed positions relative to one another on a fixedly positioned support member. A ram means is operated by a two-way hydraulic cylinder for driving supplied logs into the respective log splitting means on the forward and return strokes of the hydraulic cylinder means. The log splitting is accomplished without movement of the support member, during forward and return strokes of the hydraulic cylinder means, and logs of varying dimensions which may be greater than the diameter of the ram, and of varying grain are readily accommodated. Accordingly, a rugged and portable log splitter is provided which operates at higher speeds and with larger ram forces than previously known.

DETAILED DESCRIPTION OF THE INVENTION

The invention described herein is concerned with apparatus for splitting logs, and in particular high-power and high-speed portable hydraulic log splitting apparatus. The described invention provides a portable hydraulic log splitter which splits logs on the forward and return stroke at a higher speed and with a greater ram force than portable log splitters known in the art.

Figure 1:
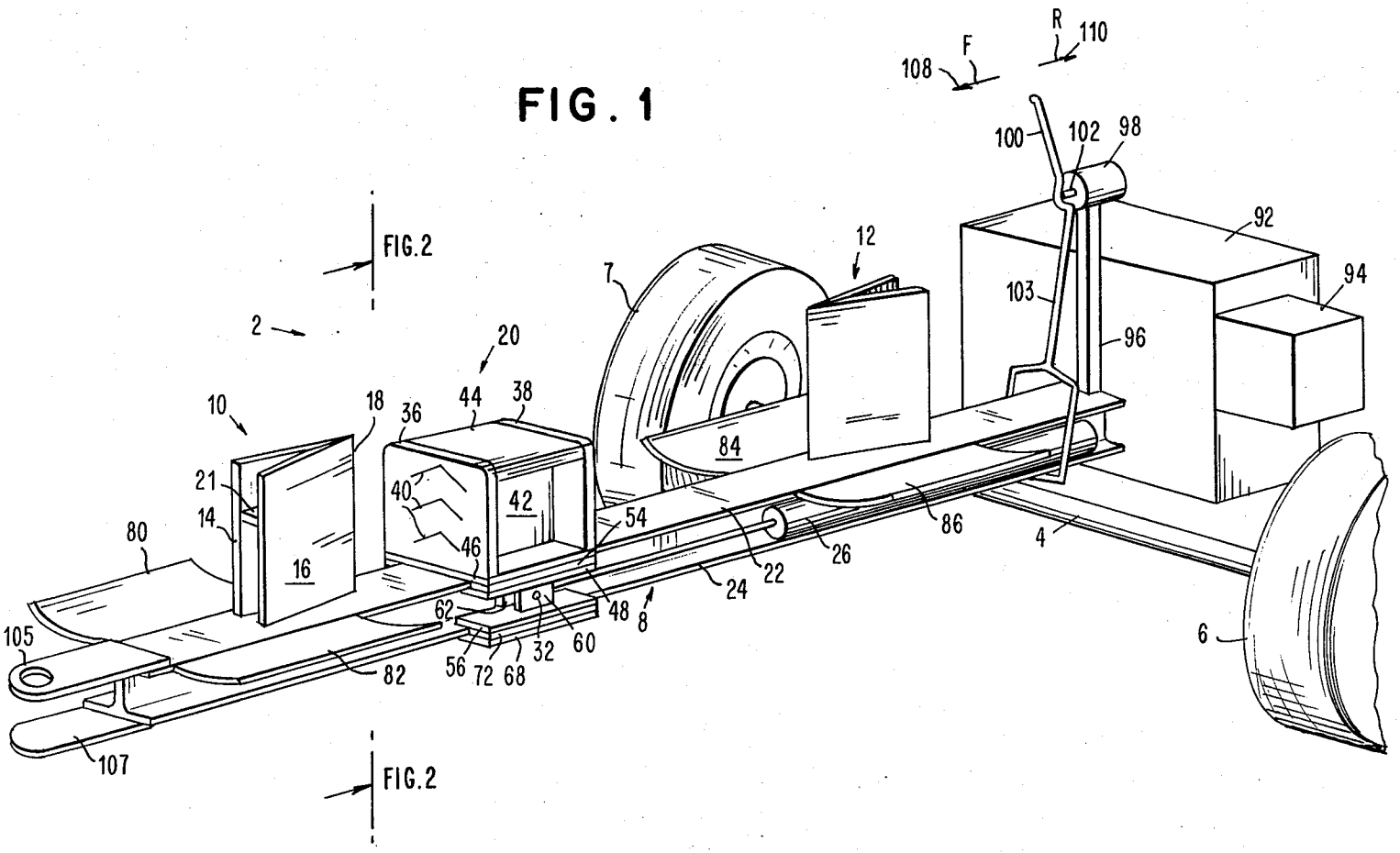
FIG. 1 is an isometric diagram of the portable hydraulic log splitter according to the present invention.
Figure 3:
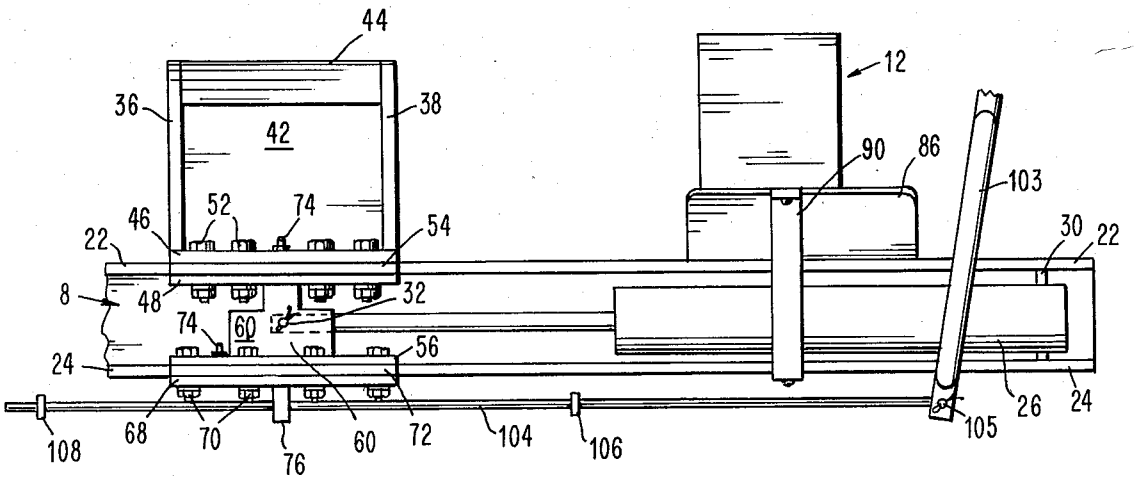
FIG. 3 is a fragmented portion of the log splitting apparatus, showing in detail the ram and the automatic stop mechanism.
Figure 2:
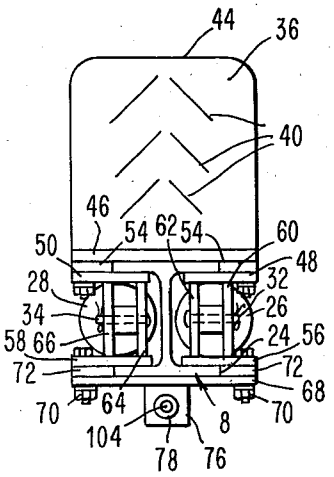
FIG. 2 is a view looking along the lines 2—2 of FIG. 1 illustrating in detail the face of the ram, and how the two hydraulic cylinders are connected to the ram for driving same.

With reference to FIGS. 1, 2 and 3, there is illustrated generally at 2 a portable hydraulic log splitter according to the present invention. A welded steel chasis 4 comprised of 6″ channel iron, has spindles (not shown) for running wheels 6 and 7, welded thereto. A longitudinally extending fixedly positioned supporting frame is comprised of an "H" beam 8. The "H" beam has 6″ wide flanges which are $\frac{3}{8}$″ thick. A first log splitting means is comprised of a front wedge 10 welded at a first fixed position on the "H" beam 8. A second log splitting means is comprised of a rear wedge 12 which is welded at a second fixed position on the "H" beam 8. Accordingly, the wedges 10 and 12 are mounted at fixed positions relative to one another on the fixed "H" beam 8. The wedges, for example, can be comprised of side members 14 and 16 which are comprised of $\frac{1}{2}$″ steel plates with a $\frac{1}{4}$″ steel plate formed therebetween as indicated at 18 to form a cutting edge which may be sharpened. A steel plate support member 21 is included for maintaining support of the wedge member when a log to be cut is forced thereagainst.

A ram 20 is slideably mounted to an upper flange 22 and a lower flange 24 of the "H" beam 8. First and second two-way hydraulic cylinder means 26 and 28 are disposed on either side of the "H" beam 8, with the body of the cylinder 26 being connected to the "H" beam by means of a pin 30. The arm of the cylinder 26 is connected to one side of the ram 20 by means of a pin 32. The arm of the cylinder 28 is connected to the opposite side of the ram 20 by means of a pin 34, and the body to the opposite side of the "H" beam by a pin (not shown).

The ram 20 includes a front face 36 and a rear face 38, with log gripping surfaces 40 being formed on the face of the ram by welding rod beads. There is included a steel plate 42 to provide transverse support between the respective faces of the ram. A channel iron plate 44 is further included to provide further upper transverse support relative to the faces 36 and 38. The front face 36 and rear face 38 of the ram 20 are welded to a lower steel plate 46 which is bolted to a steel plate 48 on one side of the "H" beam and a steel plate 50 on the opposite side of the "H" beam by means of bolts 52. Shims 54 are provided between the respective plates to provide spacing relative to flange 22 such that the mechanism may slide along the "H" beam. In practice, the shims 54 are comprised of three ⅛" shims. Therefore, a shim at a time may be removed to compensate for wear of the respective steel plates which slide on the ⅜" flanges.

Steel plates 56 and 58 are welded to support arms 60, 62, 64 and 66 which in turn are welded to steel plates 48 and 50, respectively.

The plate 56 is bolted to a steel plate 68 by means of bolts 70, with shims 72 being included such that the mechanism may slide over the "H" beam. As above, the shims 72 are comprised of three ⅛" shims. Grease fittings 74 are included, such that the mechanism may be lubricated to provide minimal friction during movement of the ram. Like grease fittings (not shown) are provided on the opposite side of the ram. A stop actuator is comprised of a metal plate 76, having an opening 78 therein.

Catch trays 80 and 82 are welded to the "H" beam 8 adjacent the front wedge 10, and catch trays 84 and 86 are welded to the "H" beam 8 adjacent the rear wedge 12. A brace 90 is welded to each catch tray and to the lower flange 24 of the "H" beam 8 to provide support for the catch trays. The catch trays may, for example, be formed of rolled steel.

A power unit 92 is supported on the chassis 4 by means of bolts or welding (not shown). As is known in the art, such a power unit may include an engine, oil reservoir, hydraulic oil cooler, a single-stage oil pump, and a filter in the hydraulic return lines. The engine, for example, may be an 18 horsepower engine and the oil pump may operate under 2000 lbs. per square inch pressure and pump approximately 9.2 gallons per minute or more. A battery 94 is included for providing starting power to the power unit 92. A support beam 96 is secured to the power unit 92 and the "H" beam 8 for supporting a hydraulic reversing valve 98, which includes a double action lever 100 connected to a double action pin 102 which connects to the hydraulic reversing valve 98. The manual control arm is further connected to an automatic stop lever 103 which in turn is connected to a traverse rod 104 by means of a pin 105. The traverse rod 104 passes through the stop actuator 76 and includes stop collars 106 and 108.

A pental hook tow bar 105 is welded to the top flange 22 to accommodate towing of the log splitter by a commercial vehicle, and a trailer ball hitch 107 is welded to the lower flange 24 to accommodate towing of the log splitter by a car or small truck.

Consider now a cycle of operation for the portable hydraulic log splitter illustrated. Assume that the ram 20 is in the position illustrated, which indicates that a log (not shown) has been split or sheared at the front wedge 10 with the catch trays 80 and 82 having caught the split log. The hydrualic reversing valve has had the manual control lever 100 pushed in the forward direction as indicated by the arrow 108, such that the stop actuator 76 on the ram has hit the stop collar 108 forcing the automatic stop lever 103 to cause the lever 100 to move the double action pin 102. The movement of pin 102 causes the hydraulic reversing valve to return to the neutral position so that the mechanism is at rest. This is a safety feature whereby the mechanism cannot be activated until the manual control lever 100 once again is actuated. The reversing valve may also be returned to the neutral position manually by means of the lever 100. The manual stop and activation is included as a safety feature.

A Log (not shown) is then placed between the rear face 38 of the ram 20 and the rear wedge 12, and the manual control lever 100 is then pushed in the rear direction as indicated by the arrow 110 causing the ram 20 to move towards the wedge 12 on the return stroke of the hydraulic cylinders 26 and 28 thereby affecting the splitting or shearing of the log. With the ram 20 travelling in the rearward direction, the stop actuator 76 then hits the stop collar 106 causing the automatic stop lever 103 to cause the double action pin 102 to return the hydraulic reversing valve 98 to the neutral position.

A log is then placed between the wedge 10 and the ram 20 and another log is split or sheared by pushing the manual control lever 100 in the direction of the arrow 108. In this instance, a log is split or sheared on the forward stroke of the cylinders 26 and 28. It is contemplated that logs on the order of 26" in length and of varying diameters may be cut by the disclosed log splitter. The diameter of the logs may be greater than the height of the respective wedges, since the force applied to the ram is larger than the force applied to rams in the prior art. It is further contemplated that a cutting cycle on the order of 6 sec. at 30 tons or more of ram pressure is achievable. Known prior art systems have a cutting cycle on the order of 8 sec. at approximately 18 ton ram force. Even greater ram forces may be achieved in the practice of the present invention by utilizing a two-stage pump in the power unit 92 for providing a larger delivery of oil per minute to the respective hydraulic cylinders. The hydraulic control lines to the hydraulic reversing valve 98 and the cylinders 26 and 28 are not illustrated, since the connections of same are well known to those skilled in the art.

The ability to use larger ram forces than those known in the prior art is due to the fact that two hydraulic cylinders 26 and 28 are used for providing the driving force to the ram. Since the arms of the cylinders are connected to respective sides of the ram, the force applied thereto is more equally distributed on the respective faces of the ram, such that the shearing forces applied to the bolts 52 and 70, which secure the ram to the "H" beam, are minimized. If a single cylinder drive mechanism is utilized as set forth in FIG. 4, the ram force is limited as a function of the shear forces applied to the bolts 52 and 70. Since much larger forces are applied to the ram through the use of two cylinders, much larger diameter logs, and logs which include knots and the like are easily split or sheared.

Figure 4:
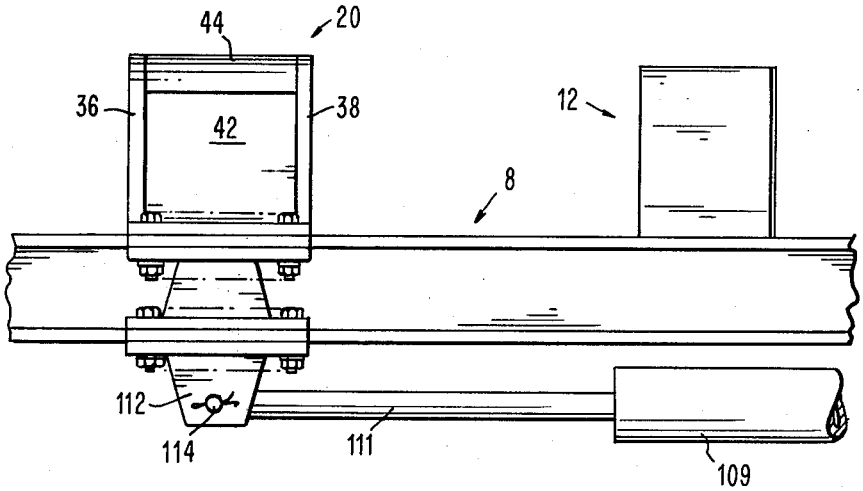
FIG. 4 is a fragmented diagram illustrating how one hydraulic cylinder means may be utilized for driving the ram.

Refer now to FIG. 4 which illustrates the portable hydraulic log splitting apparatus in which a single hydraulic cylinder 109 is provided to drive the ram 20 for light duty operation. The arm 111 of the cylinder 109 is connected by means of a pin 114 to a steel plate 112 which is welded to the lower underside portion of the ram 20. Such a configuration may be desirable when smaller diameter logs are to be split. In the preferred mode of operation, however, the two-cylinder embodiment is suggested to provide the required ram driving force for cutting larger and varying diameter logs.

Figure 5:
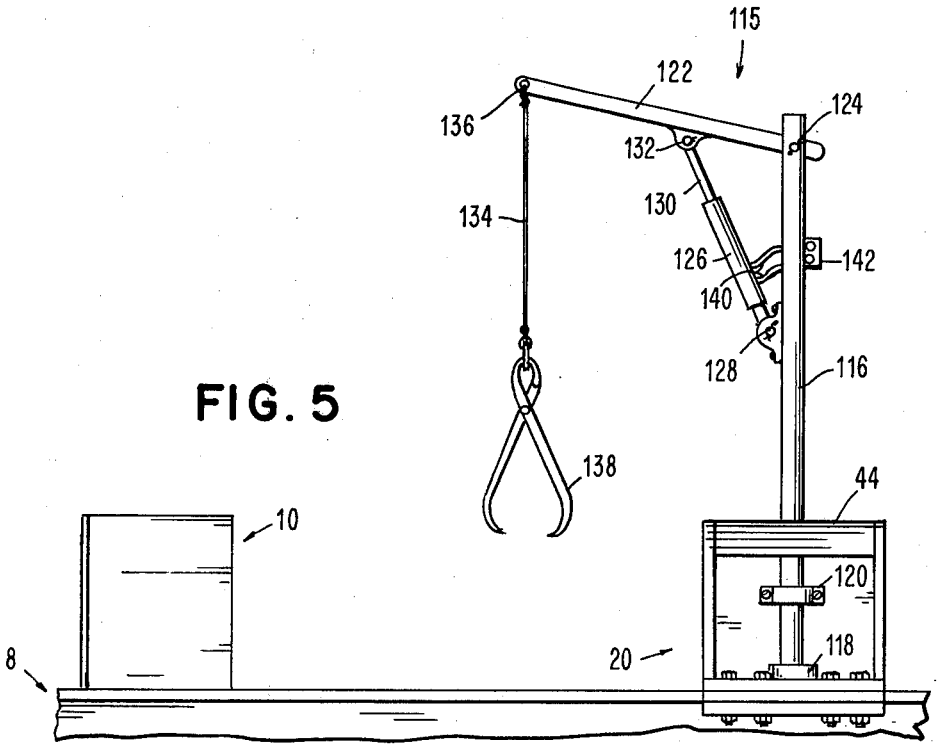
FIG. 5 is a plan view illustrating how log grapple apparatus may be operable with the ram, for supplying logs to the support member.

Refer now to FIG. 5 which illustrates how a log grappling device illustrated generally at 115 may be utilized in the practice of the present invention. The ram 20 has an opening provided in the upper channel iron plate 44, for receiving a removeable swivel boom 116 which rests in bearing support members 118 and 120. An arm 122 is rotateably mounted to the boom 116 by means of a pin 124. A hydraulic cylinder 126 is connected to the boom 116 by means of a pin 128, and has the arm 130 thereof connected to the arm 122 by means of a pin 132. A steel cable 134 is connected at one end by means of a coupling device 136 to the arm 122, and a log grapple 138 is connected to the other end. Hydraulic hoses 140 are connected between the cylinder 126 and a hydraulic valve 142, which controls the movement of the arm 122 for causing the pickup of a log from the ground by the log grapple 138 for placing the log on the "H" beam 8. Quick coupling hydraulic lines (not shown) are connected in a known manner between the hydraulic valve 142 and the master hydraulic system in the power unit 92 for providing hydraulic fluid to the valve 42. The log grapple device 114 may be swiveled about the ram manually by the boom 116.

There has been described a portable hydraulic log splitter, which provides log splitting at high speeds at larger ram driving forces, such that varying diameter logs may be split or sheared at a greater speed than those known in the prior art. This high-power high-speed log splitting is achieved by the utilization of a fixed support means, on which two log splitting wedges are mounted at fixed positions relative to one another. A ram means is slideably mounted on the fixed support beam to travel between the two wedges, for alternately splitting or shearing logs at the two wedges. The high forces applied to the ram are achieved in one embodiment through the utilization of two hydraulic cylinder means disposed on either side of the fixed support and the ram, such that the ram drive forces are supplied substantially equally across the faces thereof.

What is claimed is:

1. A hydraulic log splitter comprising:

a fixedly mounted supporting frame;

first and second log splitting wedges mounted on said frame at fixed positions relative to one another;

ram means slideably mounted on said supporting frame for movement between said first and second log splitting wedges; and first and second two-way hydraulic cylinder means, and means on opposing sides of said frame connecting said first and second two-way hydraulic cylinders to opposite sides of said ram means for applying substantially equal forces to the opposite sides thereof, to drive said ram means towards said first log splitting wedge on the forward stroke of said first and second two-way hydraulic cylinder means, and to drive said ram means towards said second log splitting wedge on the return stroke of said first and second two-way hydraulic cylinder means.

2. The combination claimed in claim 1, wherein said supporting frame comprises an "H" beam, and said first and second two-way hydraulic cylinder means are connected to opposite sides of said "H" beam and to opposite sides of said ram means, respectively.

3. The combination claimed in claim 2, including:

first and second catch trays mounted on opposite sides of said "H" beam adjacent said first wedge; and third and fourth catch trays mounted on opposite sides of said "H" beam adjacent said second wedge.

4. The combination claimed in claim 3, including a log grapple mounted on said ram means.

5. A portable hydraulic log splitter comprising:

a chasis, including spindles connected thereto, with running wheels connected to said spindles;

a longitudinally extending support beam fixedly connected at one end thereof to said chasis and substantially perpendicular thereto;

first and second splitting wedges mounted on said support beam at fixed positions relative to one another;

ram means slideably mounted to said support beam for movement between said first and second splitting wedges; and first and second two-way hydraulic cylinder means connected to said ram means to drive said ram means toward said first splitting wedge on the forward stroke of said first and second two-way hydraulic cylinder means, and to drive said ram means toward said second splitting wedge on the return stroke of said first and second two-way hydraulic cylinder means, means mounting said first hydraulic cylinder means to one side of said support beam and to one side of said ram means, and means mounting said second hydraulic cylinder means being connected to the opposite side of said support beam and to the opposite side of said ram means.

6. The combination claimed in claim 5, wherein said ram means includes first and second faces comprised of first and second metal plates which are substantially parallel with one another, and spaced apart and transversely supported by at least one metal support member.

7. The combination claimed in claim 6, wherein said support beam comprises an "H" beam, and said first and second two-way hydraulic cylinder means are connected to opposite sides of said "H" beam and to opposite sides of said ram means, respectively.

8. The combination claimed in claim 7, including:

manual control means for simultaneously controlling the operation of said first and second two-way hydraulic cylinder means.

9. The combination claimed in claim 8, including:

means for automatically stopping the cutting of logs once said first and second two-way hydraulic cylinder means has completed a forward or return stroke.

10. The combination claimed in claim 9, including:

first and second catch trays mounted on opposite sides of said "H" beam adjacent said first wedge; and third and fourth catch trays mounted on opposite sides of said "H" beam adjacent said second wedge.

11. The combination claimed in claim 10, including:

a log grapple rotateably mounted to said ram means.

* * * * *